US012765611B2

(12) United States Patent
Gawdiak-Smyth et al.

(10) Patent No.: US 12,765,611 B2
(45) Date of Patent: Oct. 20, 2026

(54) PORTABLE VAPORIZER DEVICE WITH MULTIPLE CARTRIDGE CAPABILITY

(71) Applicant: Blends Creative Inc., Toronto (CA)

(72) Inventors: Taigh Gawdiak-Smyth, Toronto (CA); Jose De Sa, North York (CA)

(73) Assignee: Blends Creative Inc., Toronto (CA)

( * ) Notice: Subject to any disclaimer, the term of this patent is extended or adjusted under 35 U.S.C. 154(b) by 860 days.

(21) Appl. No.: 18/061,670

(22) Filed: Dec. 5, 2022

(65) Prior Publication Data

US 2023/0094447 A1 Mar. 30, 2023

Related U.S. Application Data

(63) Continuation of application No. PCT/CA2021/050772, filed on Jun. 4, 2021.

(60) Provisional application No. 63/034,638, filed on Jun. 4, 2020.

(51) Int. Cl.

| | |
|---|---|
| ***A24F 40/57*** | (2020.01) |
| ***A24F 40/10*** | (2020.01) |
| ***A24F 40/30*** | (2020.01) |
| ***A24F 40/42*** | (2020.01) |
| ***A24F 40/65*** | (2020.01) |

(52) U.S. Cl.

CPC ..... *A24F 40/57* (2020.01); *A24F 40/30* (2020.01); *A24F 40/42* (2020.01); *A24F 40/65* (2020.01); *A24F 40/10* (2020.01)

(58) Field of Classification Search

CPC ..... A42F 40/30

See application file for complete search history.

(56) References Cited

U.S. PATENT DOCUMENTS

| | | | |
|---|---|---|---|
| 9,271,528 | B2 | 3/2016 | Liu |
| 9,498,002 | B1 | 11/2016 | Soreide |
| 9,936,737 | B2 | 4/2018 | Cameron et al. |
| 9,936,738 | B2 | 4/2018 | Cameron et al. |

(Continued)

FOREIGN PATENT DOCUMENTS

| | | | |
|---|---|---|---|
| CN | 209950388 | U | 1/2020 |
| WO | 2014/066730 | A1 | 5/2014 |
| WO | 2019/072966 | A1 | 4/2019 |

OTHER PUBLICATIONS

Alaguero, D.; Supplementary European Search Report issued in connection with corresponding European Application No. 21818798.7; search completed May 29, 2024.

(Continued)

*Primary Examiner* — Bradley H Philips

(74) *Attorney, Agent, or Firm* — Christopher N. Hunter; Blake, Cassels & Graydon LLP

(57) ABSTRACT

The description pertains to a portable vaporizer comprising a body having a base portion in slidable engagement with a cover portion. The body has a plurality of cradles included therein configured for receiving cartridges of consumables. The cover is movable between an open position wherein the plurality of cradles are accessible, and a closed position wherein the plurality of cradles are contained between the base and the cover. The body is further configured to house a battery, to power a heating element used to heat the consumables. A mouthpiece defining an opening through which a user would inhale vaporized consumables is in communication with the plurality of cradles.

12 Claims, 15 Drawing Sheets

(56) References Cited

U.S. PATENT DOCUMENTS

| | | | | |
|---|---|---|---|---|
| 10,039,320 | B2 | 8/2018 | Cameron et al. | |
| 10,111,468 | B2 | 10/2018 | Fornarelli | |
| 2016/0057811 | A1 | 2/2016 | Alarcon et al. | |
| 2017/0231282 | A1 | 8/2017 | Bowen et al. | |
| 2018/0020730 | A1 | 1/2018 | Alarcon et al. | |
| 2019/0098930 | A1* | 4/2019 | Fallon | A61M 15/06 |
| 2019/0358416 | A1* | 11/2019 | Woias | A61M 15/002 |
| 2020/0163382 | A1* | 5/2020 | Trzecieski | A24F 40/46 |
| 2020/0164162 | A1 | 5/2020 | Phillips et al. | |
| 2021/0195951 | A1* | 7/2021 | Niebuhr | A24F 40/50 |

OTHER PUBLICATIONS

Butler, J; International Search Report from corresponding PCT Application No. PCT/CA2021/050772; search completed Aug. 6, 2021.

* cited by examiner

PORTABLE VAPORIZER DEVICE WITH MULTIPLE CARTRIDGE CAPABILITY

CROSS-REFERENCE TO RELATED APPLICATIONS

The present application is a continuation of International PCT Application No. PCT/CA2021/050772 filed on Jun. 4, 2021, which claims priority from U.S. Provisional Application No. 63/034,638 filed on Jun. 4, 2020, the contents of which are incorporated herein by reference in their entireties.

FIELD OF THE DESCRIPTION

The description is directed to a portable vaporizer device. In particular, the description is directed to a portable vaporizer device that can be used with multiple cartridges.

BACKGROUND

Portable vaporization devices, also known as 'vape pens' have been growing in popularity as they offer a healthier alternative to traditional cigarettes or hand-rolled substances. Vape pens are electronic devices designed to heat a particular substance and turn it into vapor for inhalation thereof. Portable personal vaporization devices provide easy, convenient and discrete use with a reduction in potency of aroma compared with traditional smoking.

Portable vaporization devices are designed to vaporize consumables. consumables can come in many forms, for example, herb, waxes, resins or consumable. E-liquids, also called e-juice or vape juice, are specifically designed, distillates, concentrates or other consumable liquid and typically contain some type of active ingredient, for example nicotine, cannabinoids or terpenes. Many portable vaporization devices currently on the market are designed to work with a single e-liquid cartridge. This limits the user's ability to customize their vaping experience. For example, if the user wanted to experience the benefits of cannabinoids with a specific terpene, they would have to find a single cartridge that had the cannabinoid concentration and terpene of interest.

Multi-cartridge vaporization devices have two cartridges are becoming more available on the market. These designs allow for the customization of the vaping experience which could not be realized by the single cartridge designs. Having two cartridges in one device allows the user to select the concentration of the contents of each of the cartridges to customize their experiences to their preferences. Currently, such double cartridge designs contain a battery and logic device for each cartage. This design is inefficient and is not cost effective to manufacture.

Many of the portable vaporization devices on the market require that the cartridge be loaded in the longitudinal direction of the vape pen. Some designs require that the cartridge be screwed in while other clip in. Both designs this can be difficult to align making the insertion of cartridges cumbersome.

SUMMARY OF THE DESCRIPTION

The description pertains to a portable vaporizer comprising a body having a base portion in slidable engagement with a cover portion. The body includes a plurality of cradles included therein configured for receiving cartridges of consumables. The cover is movable between an open position wherein the plurality of cradles are accessible, and a closed position wherein the plurality of cradles are contained between the base and the cover. The body is further configured to house a battery, to power a heating element used to heat the consumables. A mouthpiece defining an opening through which a user would inhale vaporized consumables is in communication with the plurality of cradles.

In another aspect, there is a portable vaporizer system comprising a vaporizer device and at least one cartridge containing consumables. The vaporizer device comprises a body having a base portion in slidable engagement with a cover portion. The body has a plurality of cradles included therein which are each configured for receiving one of the at least one cartridge. The cover is movable between an open position wherein the plurality of cradles are accessible, and a closed position wherein the plurality of cradles are contained between the base and the cover. The body is configured to house a battery to power a heating coil which is configured to heat and vaporize the consumable within the at least one cartridge. The body further comprises a mouthpiece defining an opening which is in communication with the cartridge to facilitate the inhalation of the vaporized consumable therethrough.

In another aspect, there is a portable vaporizer comprising a body having a base portion in slidable engagement with a cover portion. The body has a plurality of cradles included therein configured for receiving cartridges of consumables. The cover is movable between an open position wherein the plurality of cradles are accessible, and a closed position wherein the plurality of cradles are contained between the base and the cover. The body is further configured to house a battery, to power a heating element used to heat the consumables. A mouthpiece defining an opening through which a user would inhale vaporized consumables is in communication with the plurality of cradles. The body further comprises at least a first compartment and a second compartment and a division there between. The division has at least one choke hole, sized to restrict airflow between said first compartment and said second compartment.

BRIEF DESCRIPTION OF THE FIGURES

The features of certain embodiments will become more apparent in the following detailed description in which reference is made to the appended figures wherein.

DETAILED DESCRIPTION

The terms "comprise", "comprises", "comprised" or "comprising" may be used in the present description. As used herein (including the specification and/or the claims), these terms are to be interpreted as specifying the presence of the stated features, integers, steps or components, but not as precluding the presence of one or more other feature, integer, step, component or a group thereof as would be apparent to persons having ordinary skill in the relevant art. Thus, the term "comprising" as used in this specification means "consisting at least in part of. When interpreting statements in this specification that include that term, the features, prefaced by that term in each statement, all need to be present but other features can also be present. Related terms such as "comprise" and "comprised" are to be interpreted in the same manner.

Unless stated otherwise herein, the article "a" when used to identify any element is not intended to constitute a limitation of just one and will, instead, be understood to mean "at least one" or "one or more"

Figure 1:
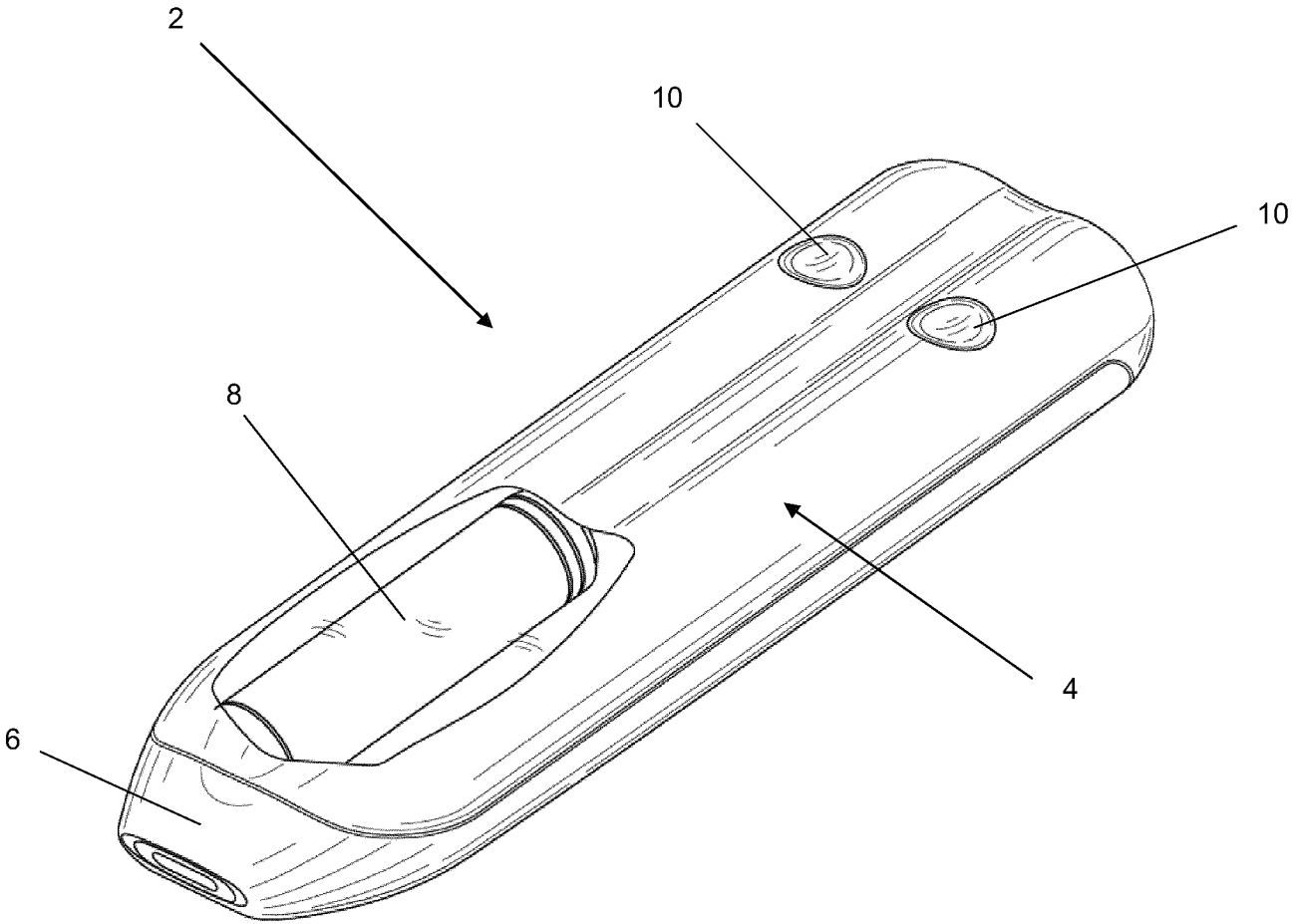
FIG. 1 is perspective view of a first embodiment of a portable vaporization device in the closed position with one cartridge inserted therein.
Figure 2:
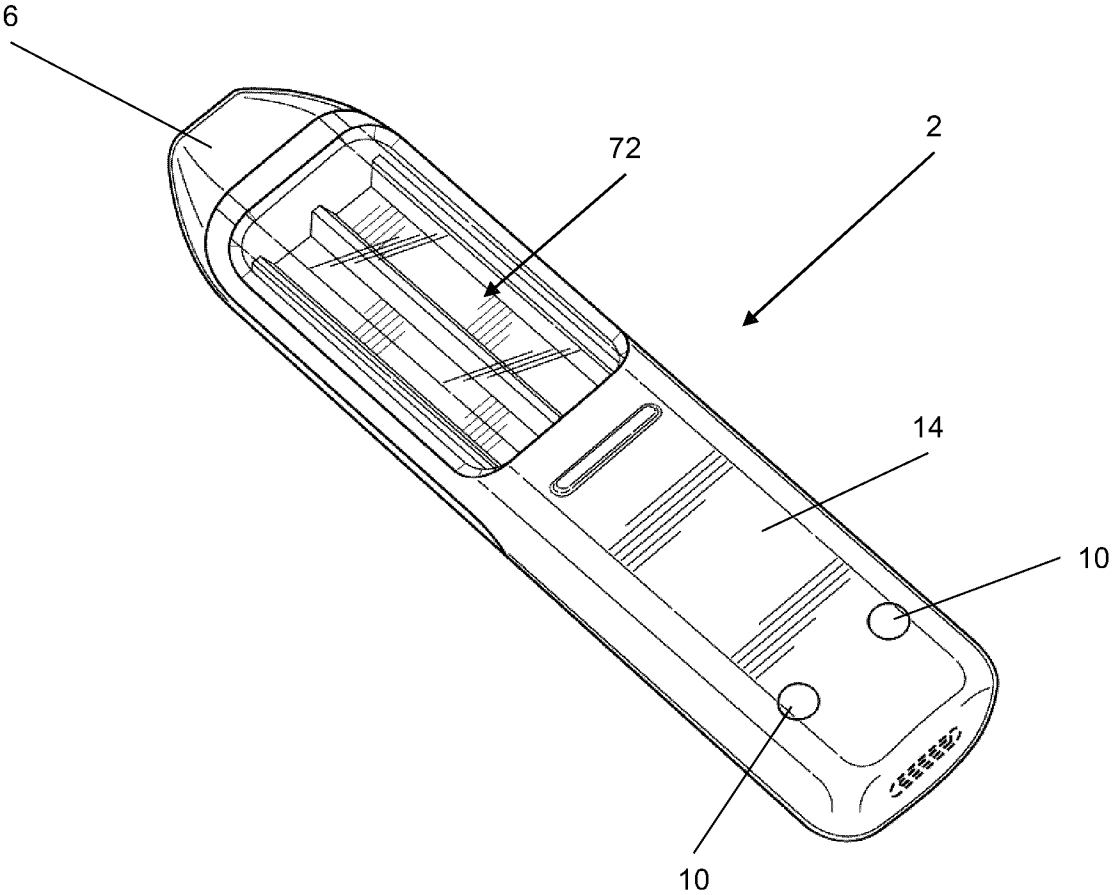
FIG. 2 is a is perspective view of a first embodiment of a portable vaporization device in the closed position.

FIG. 1 shows a perspective view of a first embodiment of a portable vaporizer device 2. The portable electric vaporizer device, hereinafter "the vape pen". A second embodiment of the vape pen 2 is shown in FIG. 2. The vape pen 2 shown in the figures is designed for use with consumables. In the embodiments shown in the figures, the consumable is a liquid, however, as can be appreciated by a person skilled in the art, the vape pen 2 could be adapted for use with herbs, wax or any other suitable substance known to a person skilled in the art. In this description, the term consumable will be used to describe any substance that could be contained within the pod including, but not limited to e-liquid, distillates, waxes, resins, and/or concentrates.

Figure 3B:
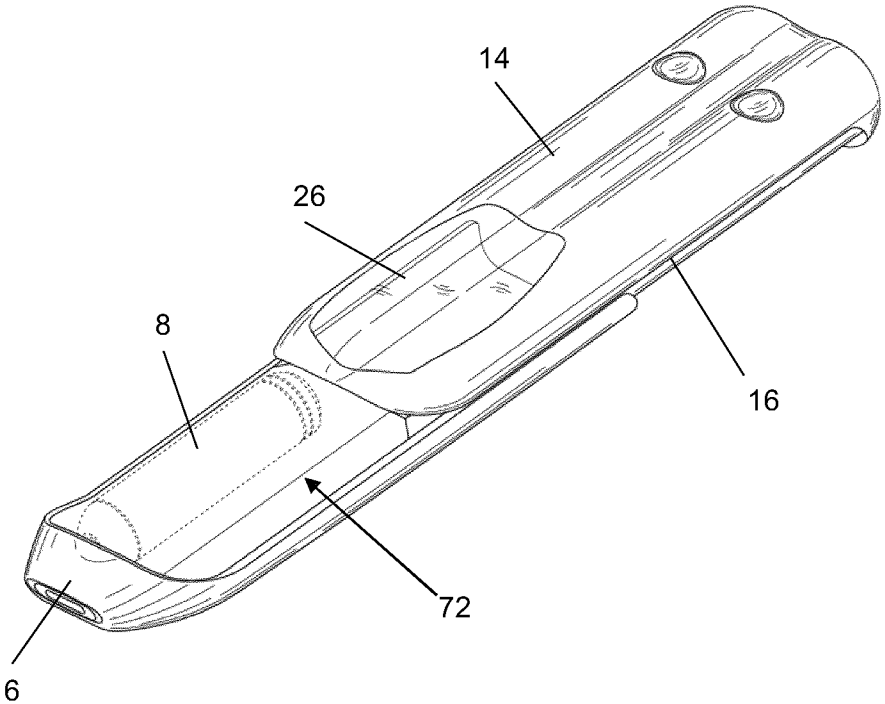
FIG. 3B is a perspective view of the portable vaporization device in the open position with one cartridges inserted.
Figure 3A:
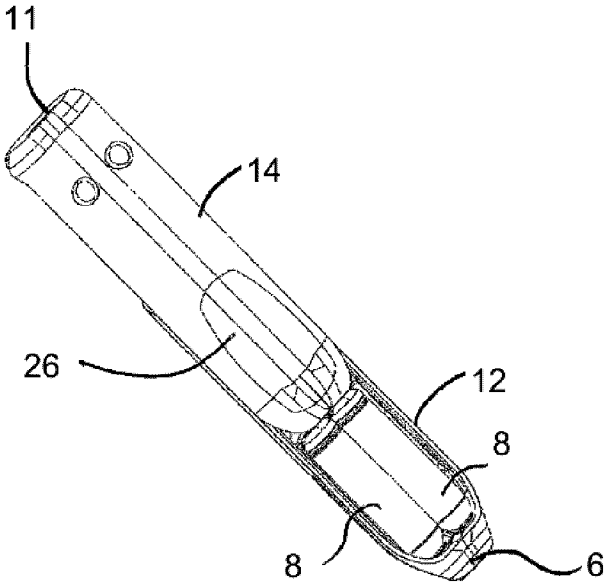
FIG. 3A is a perspective view of the portable vaporization device in the open position with two cartridges inserted.

The vape pen 2 has a body 4 having first end configured with a mouthpiece 6. The body 4 of the vape pen 2 houses one or more consumables cartridge 8 in a cartridge cavity 72 therein. In there first embodiment shown in FIG. 1, the cartridge cavity 72 is included in a base 12 of to the body 4 of the vape pen 2. In the alternative embodiments shown in FIGS. 3 and 4, the cartridge chamber 72 is formed as part of the cover 14. In the examples shown in the figures, the vape pen is configured to accept two cartridges. However, as can be appreciated by a person skilled in the art, the number of cartridges could vary. Specifically, embodiments with 2-4 cartridges would be preferred. While more cartridges have been contemplated and would be possible, a vape pen with two cartridges is preferred. A pen with two cartridges limits the amount of dilution if one chamber does not hold a cartridge. Furthermore, the feel of the draw of the vape pen has been found to be relatively consistent with a two-cartridge design.

Figure 8:
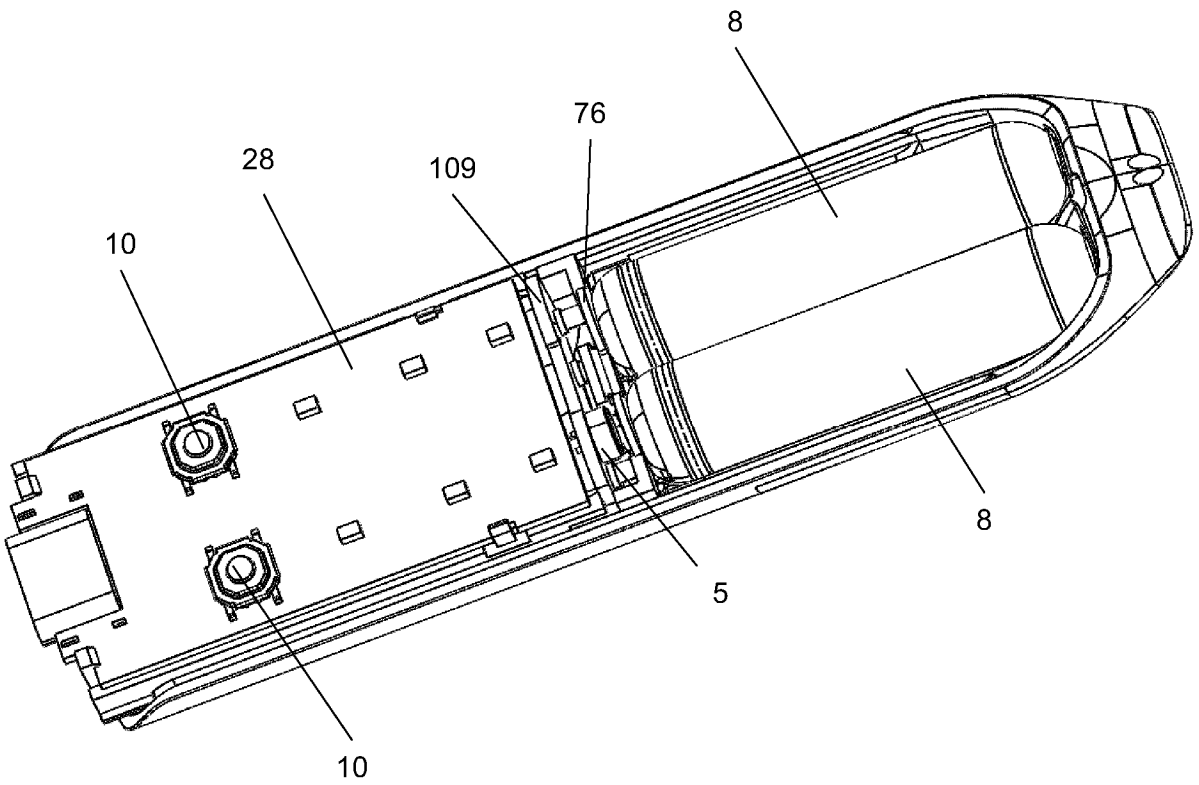
FIG. 8 is a perspective view of the portable vaporization device with the top cover removed to show the inside thereof.

At the opposite end of the cartridge cavity 72, there is an electronic compartment 74 for housing at least battery 3 for powering the vape pen 2 and a logic device 28 for controlling the heating components to vaporize the consumable for consumption (shown in FIG. 8).

Figure 10:
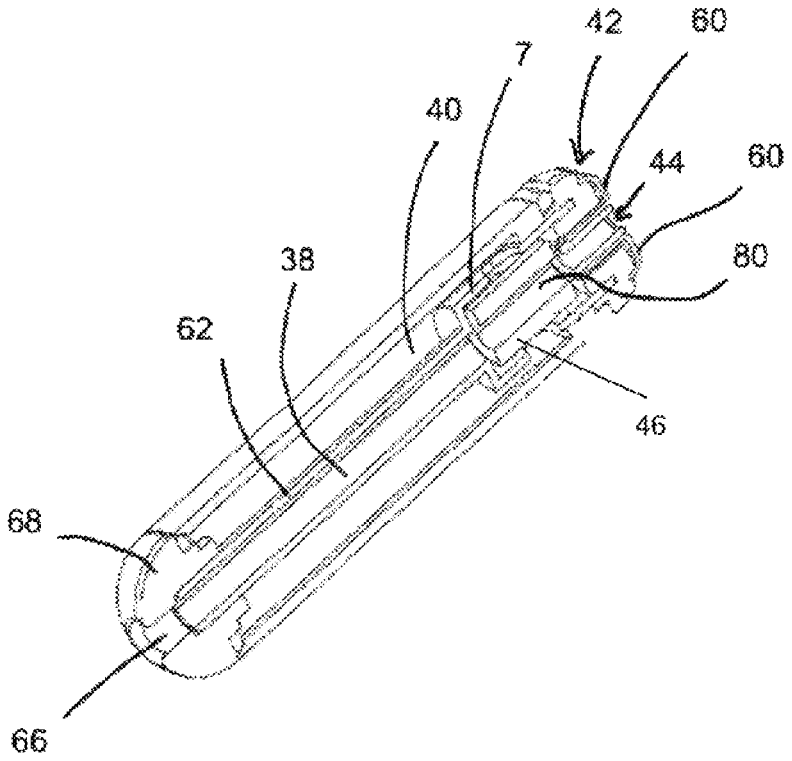
FIG. 10 is a cross sectional view of the cartridge.

When in use, a user provides a suction force through the mouthpiece 6 of the vape pen 2, typically by inhaling through the mouthpiece 6. This activates suction sensors 5 (shown in FIG. 8). When the suction sensors 5 are activated, a signal is sent to a logic device 28, which in turn, is responsible for activating at least one heating element 46. In a preferred embodiment, the heating elements 46 are contained within each cartridge 8 (as shown in FIG. 10). Thus, heating elements 46 can only be activated if a cartridge is inserted in the vape pen 2. In an alternative embodiment, one suction sensor is used to control the heating elements 46 of both cartridges.

Figure 9:
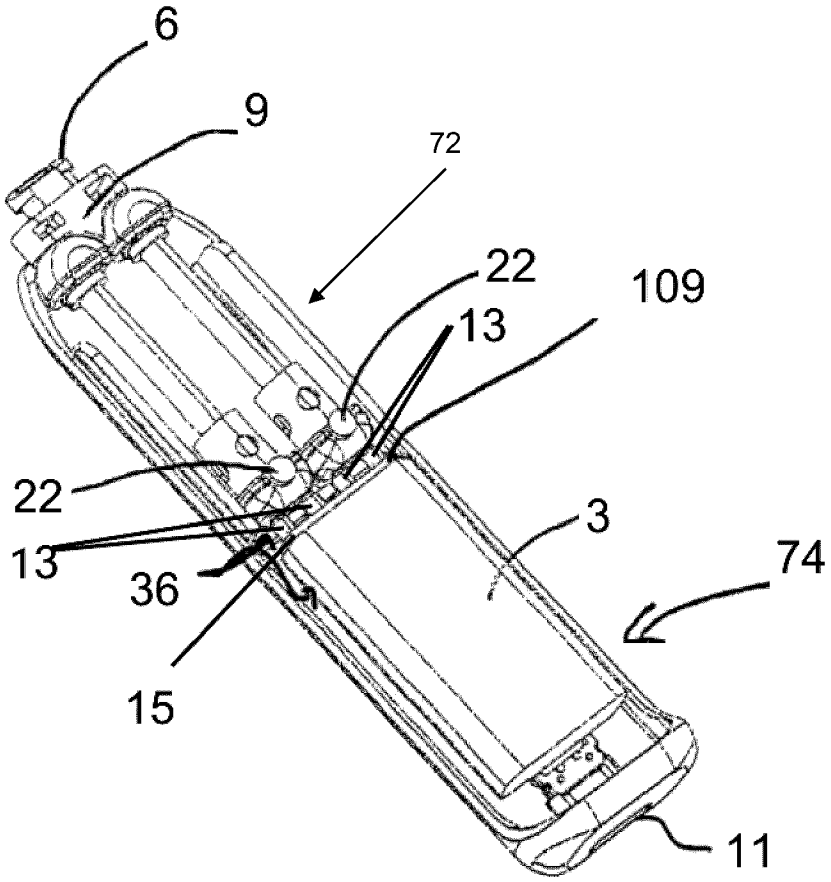
FIG. 9 is a perspective view of the portable vaporization device omitting the bottom surface to show the inside thereof.

Referring to FIGS. 9 and 10, the air is drawn into the vape pen 2 from the atmosphere along the entire or partial length of the interface of a base 12 and cover 14. Alternatively, air intake passages or holes could be provided to allow air from the atmosphere to be drawn into the vape pen 2. This embodiment allows for further control of the airflow draw and provides a consistent user experience. The air enters into the cartage through an intake channel 44 in the electrical side endcap 42 of the cartridge 8. The air is then drawn through a center channel 80 in a heating element 46 and continues through a tubular member 62 before exiting the cartage 8 through an exit channel 66 in the mouthpiece side endcap 68. The mouthpiece 6 comprises a mixing chamber 9 therein. The air passes through the mixing chamber 9 and out the end of the mouthpiece 6.

When active, the heating elements 46, contained in the cartridge 8, heat the consumable to provide a vapour. The heating elements are preferably a porous ceramic heating element which allow the e-liquid to saturate the heating element 46, however, alternative arrangements such as a wire coil used with a wick (for example a silica stranded rope wick) could be used. Within the cartridge, the consumable is contained in chamber 40. The heating elements 46 are located within a housing 7 located proximal the consumable. The housing 7 is located, preferably concentrically, within the chamber 40 and is coupled to the tubular member 62 extending longitudinally though the length of the cartridge 8. The tubular member 62 serves to define the airflow channel 38 and separate the consumable from the airflow channel 38. Located adjacent and preferably concentrically within the housing 7 is the heating element 46. The housing 7 has at least one, but preferably a plurality of orifices through the sidewalls thereof to allow the consumable to flow through the housing 7 to saturate the heating element 46. The heating element heats the consumable to an appropriate temperature such that the active ingredients in the consumable are vaporized. Heating temperatures vary based on the content of the consumable, however for an consumable containing cannabinoids and/or terpenes, temperatures between 175 and 200 degrees Celsius are preferred with a further preferred range of 180-190° C. for optimal vaporization without a burning flavor. The vapour then travels through the airflow channel 38 and is drawn out through a hole 66 in the mouthpiece side endcap 68 of the cartridge 8. As the hole 66 in the mouthpiece side endcap 68 is in communication with a mixing chamber 9 (shown in FIGS. 9 and 11).

Figure 11:
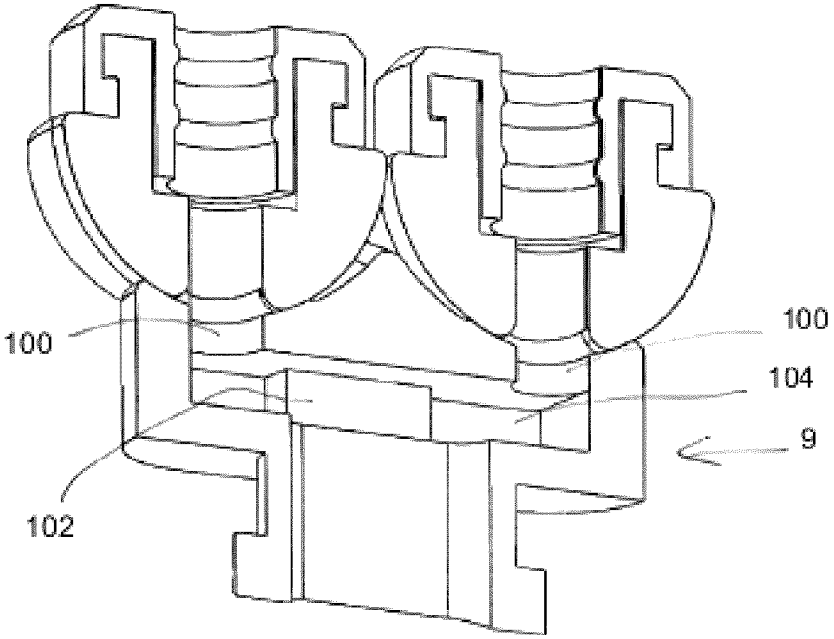
FIG. 11 is a lateral cross-sectional view of the mixing chamber and mouthpiece side endcaps of the cartridges.
Figure 12:
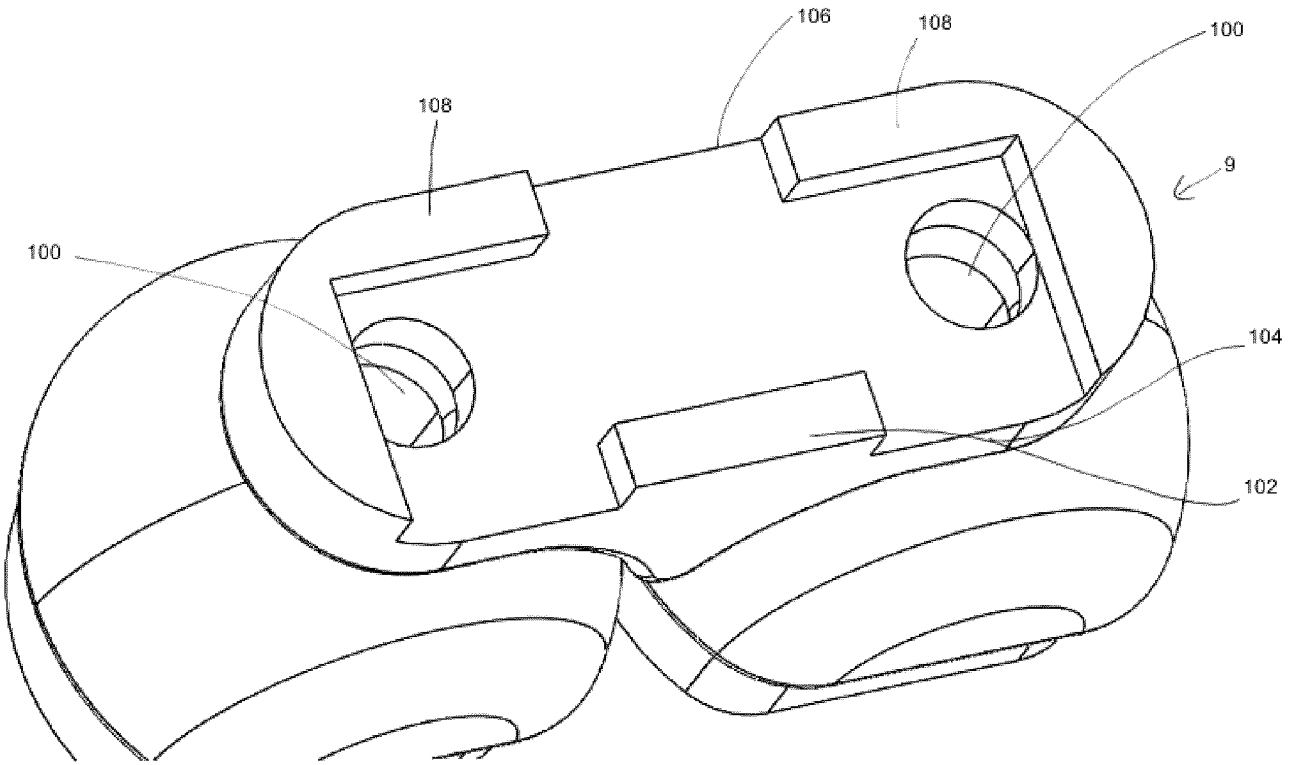
FIG. 12 is a vertical cross-sectional view of the mixing chamber.
Figure 13:
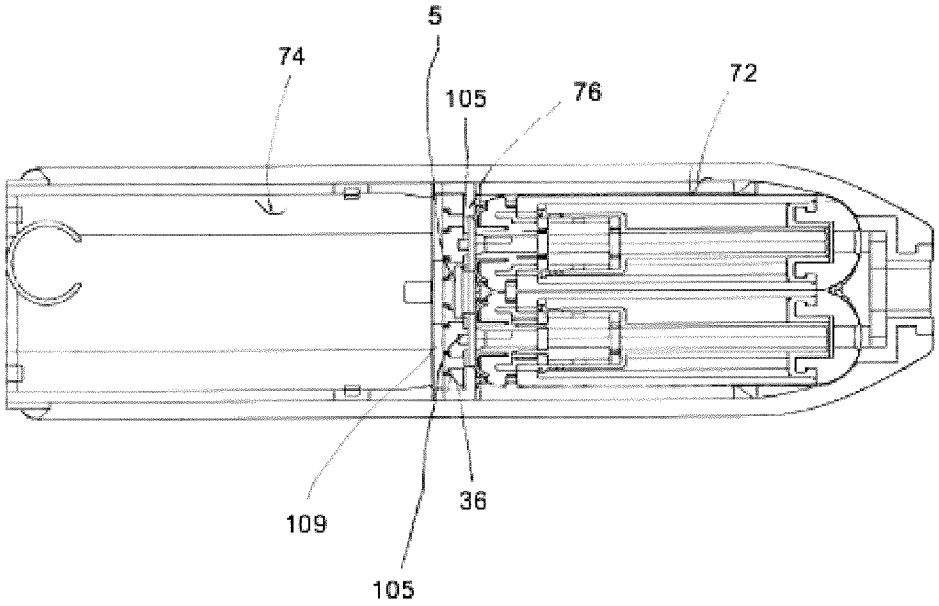
FIG. 13 is a partial lateral cross-sectional view of the portable vaporization device.

As the vapours from the plurality of cartridges are drawn into the mixing chamber 9, they are encouraged to mix and blend together before being inhaled by the user. The geometry of one embodiment of the mixing chamber 9 is shown in FIGS. 11 and 12. FIG. 11 shows a horizontal cross section of an example mixing chamber 9 while FIG. 12 shows a vertical cross section. The example mixing chamber 9 comprises two holes 100, each aligned with the exit channel 66 in the mouthpiece side endcap 68 of the cartridges 8. The example mixing chamber further includes a first elevated ridge 102 extending from a first wall 104 of the example mixing chamber 9. This first elevated ridge 102 is located generally intermediate the first wall 104 between the two holes 100. A second wall 106 of the mixing chamber 9, located opposite the first wall 104, includes two elevated ridges 108, generally aligned with the holes 100. When in use, each pod produces vapors separately. These vapors are drawn by inhalation through the holes 100 and into the mixing chamber 9. The internal geometry of the mixing chamber 9 causes turbulent mixing of the vapor before being expelled as a mixed vapor through the mouthpiece. In a preferred embodiment, the mixing chamber 9 is made of silicone or another suitable flexible material. The use of the flexible material in this preferred embodiment is to provide a 'spring-loaded' seal (via elastic deformation) of the mixing chamber against the cartridges. The flexibility of the mixing chamber in the preferred embodiment further adds to the turbulent flow as it deforms during the force of the inhalation. In a different preferred embodiment, the mixing chamber 9 is made of ceramic material. It can be formed as a separate or integral part of the mouthpiece. Using ceramic provides for longevity of the mixing chamber 9 while still providing well mixed vapor. In yet a further embodiment, the mixing chamber 9 is omitted.

As can be appreciated by a person skilled in the art, other geometries which would cause turbulent mixing of the two vapors could also be used. The turbulent flow of the vapor through the mixing chamber 9, in combination with the designed air flow path described below, leads to consistent blending of the vapour produced by the plurality of cartridges.

Contained within the body 4 of the vape pen 2 is the battery 3 (shown in FIG. 9) for powering the vape pen. The battery 3 coupled to a charging port 11 for charging the battery without requiring the removal of the battery from the device. Although the example in the figures shows a USB charging port, this is simply one example of a charging port. Many suitable alternative charging arrangements would be known to a person skilled in the art. Examples include but are not limited to USB type C ports, USB A ports, Micros USB, or a power cable port. Alternatively, the battery could be charged inductively.

Contact pins 13 extend from a battery cradle 15 and make contact with the cartridge contact terminals 60. This the battery provides power to the cartridge to power the heating element 7.

Preferred Control of Airflow Through the Vape Pen

Figure 14:
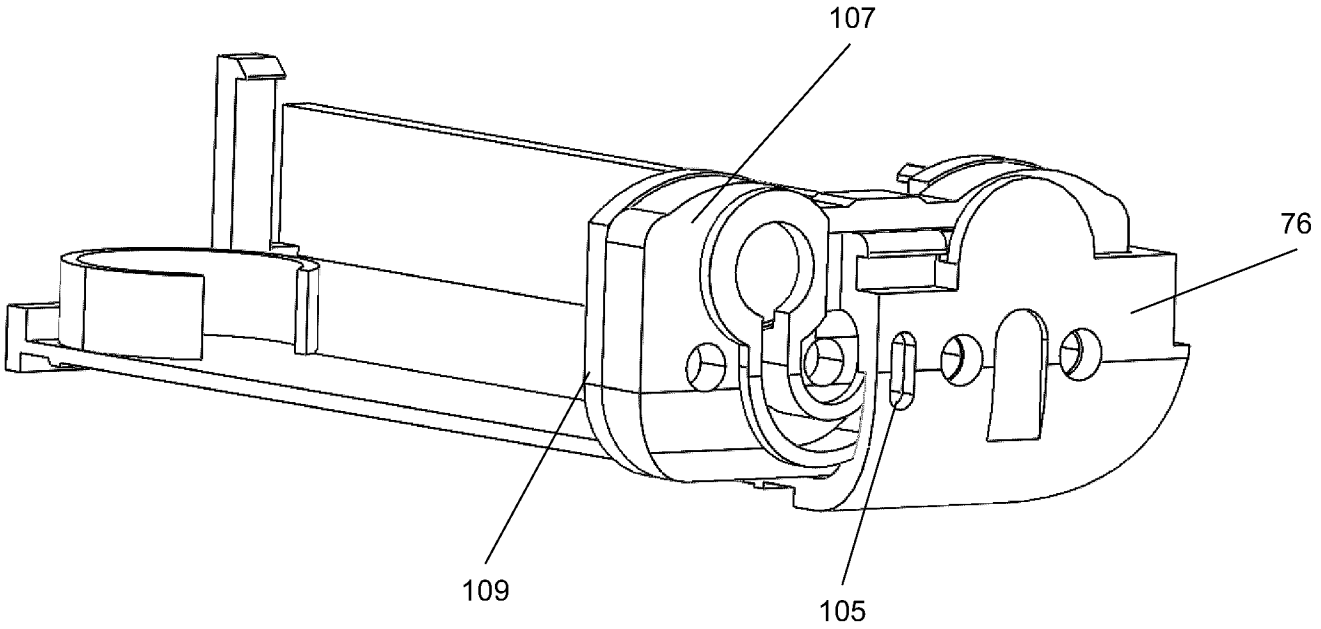
FIG. 14 shows a partial sectional view of the separation between the electrical compartment and the cartridge compartment of the portable vaporization device.

In a preferred embodiment shown in FIG. 9, the airflow through the pen is carefully controlled using structures built into the vape pen 2. The electrical compartment 74 contains a printed circuit board 109 at the end thereof, separating the electrical compartment 74 from the cartridge compartment 72. As air is drawn in by the vacuum pressure of a user's inhale at the mouthpiece 6, the air enters the vape pen 2 from the atmosphere along the interface of a base 12 and cover 14 which make up the body 4 of the vape pen 2. As detailed above, for further control of the intake air from the atmosphere, intake passages or holes could be provided either exclusively or in combination with the air entry along the interface of the base 12 and cover 14. In one embodiment, the electronics compartment is generally sealed from atmospheric air when the cover 14 is in a closed position by a silicon seal 107 (shown in FIG. 14) that sits between the wall 76 and the printed circuit board 109 which hold the contacts and the pressure sensor 5. While it can be appreciated that the printed circuit board disclosed herewith provides a wall-like barrier between the electrical compartment 74 and the cartridge compartment 72, in an alternative embodiment, a wall or other suitable barrier could be used. The pressure sensor 5 (shown in FIG. 8) in the electronics compartment is activated via the pressure differential between the electrical compartment 74 and the cartridge compartment 72 caused by the vacuum from inhalation, which is measurable at a small orifice 105 in the wall 76. This orifice 105 is preferably distanced from the intake channels 44 of the cartridges, so as to avoid ingress of consumable into the electronics compartment 74. The pressure sensor 5 is located such that one side is exposed to the cartridge compartment 72 while the opposite sides is exposed to the generally sealed electronics compartment 74. The term generally used herein would be understood by a person skilled in the art to mean that the electronics compartment is sealed at least sufficiently as to allow for a pressure differential to exist between the electronics compartment 74 and the cartridge compartment 72 during a user's inhalation.

When all the cartridge cradles are full (i.e. the maximum number of cartridges are inserted), the choke hole or holes 105 serve to control the speed at which air can be drawn from the environment through the electrical compartment 74 and into the cartridges 8. This allows for a more consistent pull for the user.

In an embodiment where less than the maximum number of cartridges are inserted, the airflow is still controlled by being pulled through the choke holes 105 and into any void cartridge cradles. This is advantageous over designs wherein the flow of air is controlled via the structure of the cartridge. In such designs, when less than the maximum number of cartridges are inserted, the air flows freely and quickly though the empty cartridge compartment. Thus, the vapour from the inserted cartridge is diluted substantially. The incorporation of the choke holes 105, limits the amount of air from the empty cartridge cradle that enters the mixing chamber 9. Thus, the dilution of the vapour from the inserted cartridge is minimized.

Cartridge Insertion and Removal

Figure 4:
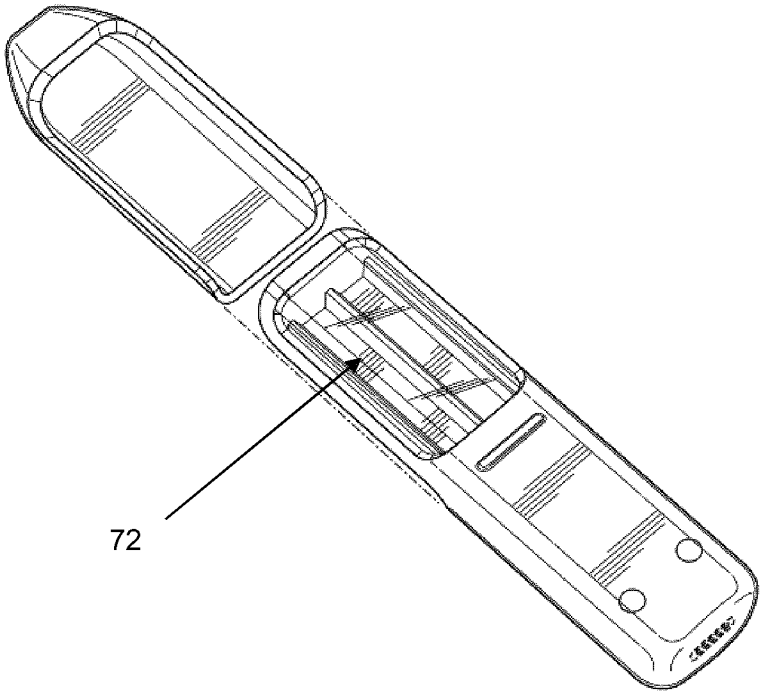
FIG. 4 is a perspective view of a second embodiment of the portable vaporization device with the base removed from the cover.
Figure 5:
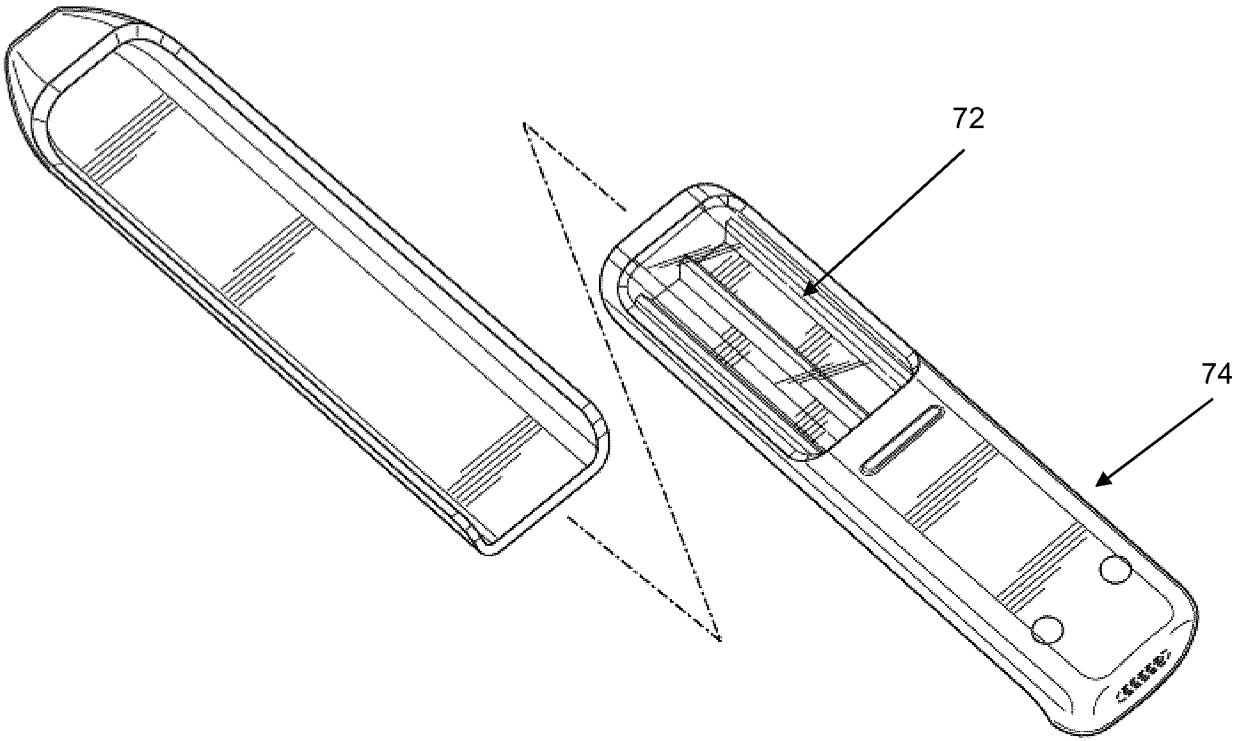
FIG. 5 is a perspective view of a third embodiment of the portable vaporization device with the base removed from the cover.
Figure 15:
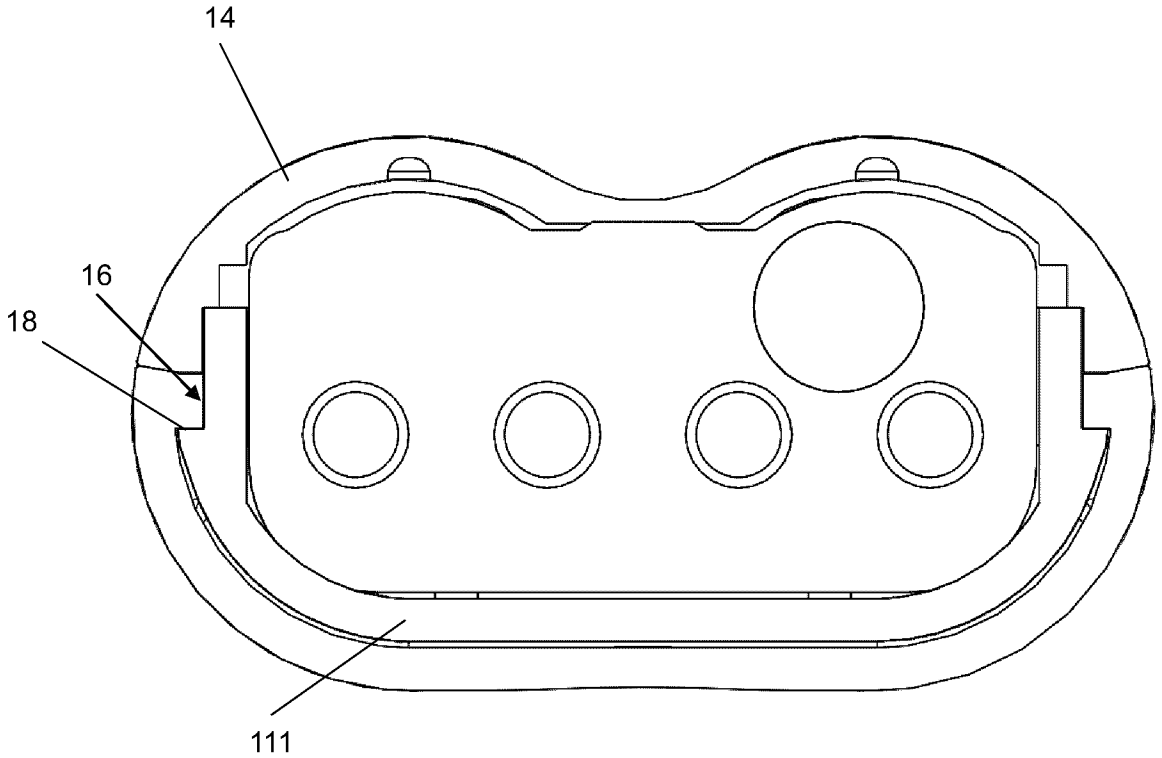
FIG. 15 is a vertical cross section of the device showing the cover, inner support bed and base of the portable vaporization device.

The body 4 of the vape pen 2 comprises the base 12 and the cover 14. The cover 14 slidably engages the base 12 and is movable between a closed position, shown in FIG. 1 in which access to the cartridges 8 is prohibited, and an open position, shown in FIGS. 3A and 3B, where the cartridges are accessible to the user. FIGS. 4 and 5 show a second and third embodiment of the vape pen 2 wherein the cartridge cradle is part of the cover 14. As noted by comparing FIGS. 4 and 5, the length of the base can vary. Furthermore, a magnet can be used to help ensure the base and the cover are securely connected. In this embodiment, the cradle is spaced downwardly from the top of the cover 14 and in a preferred embodiment, is positions such that the cartridges, when inserted can be seen through a window in the cover 14. In this embodiment the cartridges are inserted longitudinally with respect to the long axis of the vape pen 2. In the preferred embodiments, the cover 14, is mated with an inner support bed 111 (shown in FIG. 15). Together the cover 14 and inner support bed 111 create a channel 16. A ridge 18 extending inwardly from the base 12 wall engages the channel 16 to provide a sliding engagement of the base 12 relative to the cover 14 and inner support bed 111. This slidable engagement can preferably include a child resistant locking mechanism. In a preferred embodiment, the child resistant locking mechanism would be disengaged by a combination of pushing down on the cover while providing a backwards sliding force. In an alternative embodiment a digital child lock is incorporated into the pen. In this embodiment, the user would, for example, hold down one of the control buttons for 5 seconds to allow the vape pen 2 to be activated via a user's inhalation. In an alternate embodiment, a child resistant locking mechanism in which the sides of the cover are pinched when providing a backward sliding force could be used. It can be appreciated that various alternative child resistant locking mechanisms would be known to a person skilled in the art.

Figure 6:
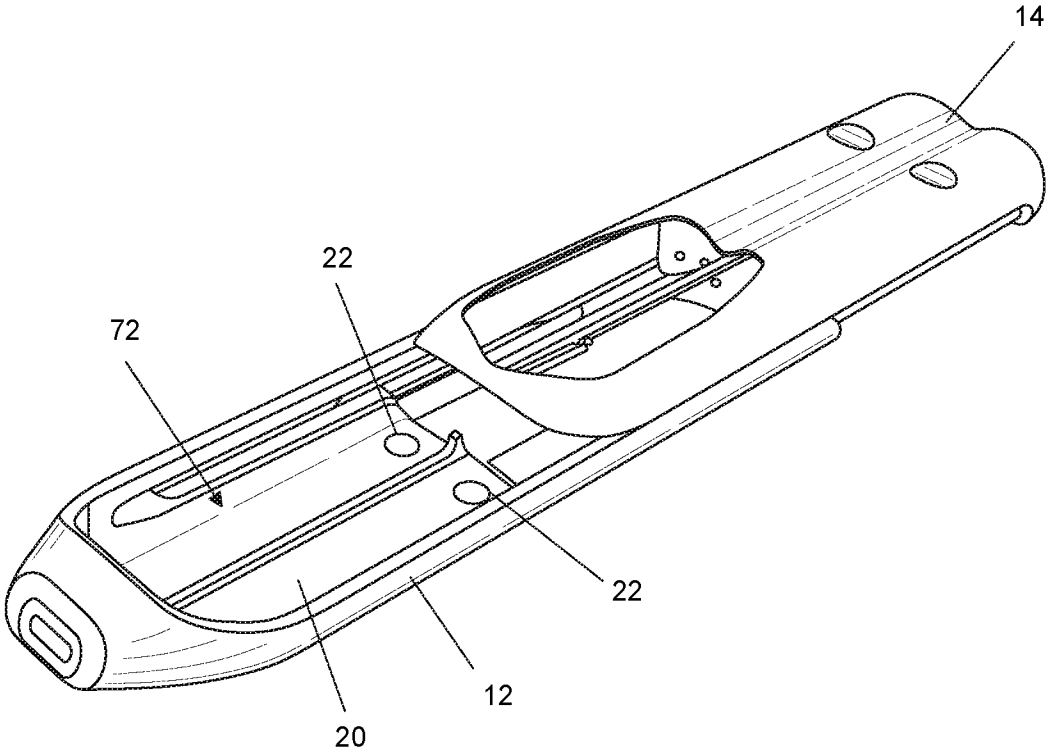
FIG. 6 is a perspective view of the portable vaporization device in the open position.

FIG. 6 shows the vape pen 2 with the cover in the open position without cartridges inserted in the vape pen 2. The base 12 of the vape pen 2 includes the plurality of cartridge cradles 20. The cradles 20 are each fitted with a magnet 22, preferably positioned at one end of the cartridge cradle. Each cartridge cradle 20 is formed to generally conform to the shape of a cartridge. Although the shape of the cartridge could vary, in the preferred embodiment, the cartridges are cylindrical.

In the first embodiment shown in FIGS. 1, 2 and 3A and 3B, the slidable arrangement of the cover 14 to the base 12 allows for insertion of the cartridges 8 into the vape pen 2 in a lateral manner. This is advantageous over previous designs which required that the cartridge be aligned longitudinally with the pen body. A longitudinal insertion of the cartridge can be difficult to align and cumbersome to complete. The lateral loading design provides ease of alignment of the cartridge into the vape pen. In a preferred embodiment the entirety of the cartridge cradle 20 is exposed when the cover 14 is in the open position. In this preferred embodiment, aligning the cartridges is as simple as placing the cartridge in the cradle from the top of the vape pen 2.

In all embodiments, the sliding arrangement of the cover 14 to the base 12 is further advantageous in that in the closed position, the cartridges are fully encapsulated within the interior of the vape pen 2. This aids to prevent unwanted removal of the cartridges and allows for the inclusion of a simple child resistant lock. In a preferred embodiment, the cover 14 of the vape pen 2 is preferably fitted with a window 26 to allow the user to view the cartridges within. This allows the user to monitor how much consumable remains in each cartridge. In a further preferred embodiment, the cartridges are labeled according to their contents in such a manner that the user could view the description of the contents of the cartridge through the window. This is beneficial, for example, in a household with multiple users as each user could identify their vape pen from the contents of the cartridges.

In one embodiment, each cartridge 8 comprises a cartridge magnet 24 of opposite polarity to cradle magnets 22. The cartridge magnet 24 is positioned on the cartridge 8 such that when the cartridge 8 is in the inserted position, the cartridge magnet 24 is generally adjacent the cradle magnet 22. It can be appreciated that the magnet position can be varied, for example, but not limited to, on either end of the cradle and equivalent securement would be achieved.

The attraction between the cartridge magnet and the cradle magnet holds the cartridge in place. This is particularly useful when the cover 14 is in the open position as the cartridge will not move around with movement of the vape pen. The magnet engagement also serves to aid in ensuring proper positioning of the cartridge 8 within the cartridge cradle 20. In a preferred embodiment, the user will feel a "snap" of the cartridge 8 in the cradle 20 to provide a physical feedback that the user has properly inserted the cartridge 8 into the cradle 20. While this is shown in the figures using the example of the first embodiment, it can be appreciated that a magnet could be positioned in the cradle of the second embodiment to provide equivalent securement.

Figure 7:
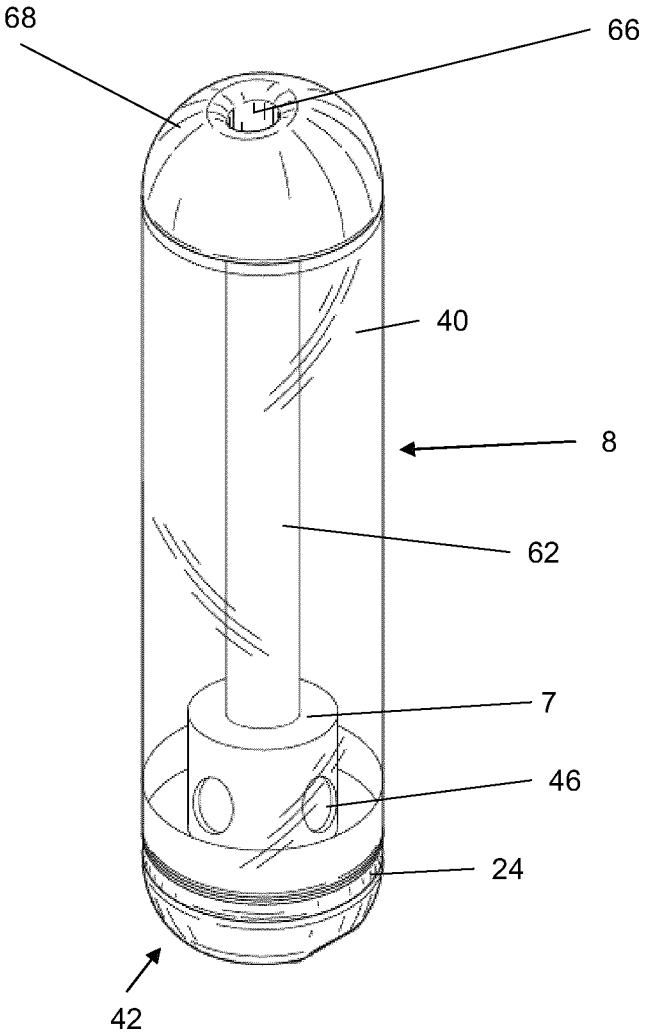
FIG. 7 is a perspective view of the cartridge.

In the preferred embodiment, shown in FIG. 7, the cartridge magnet 24 comprises a ring around a top portion of the cartridge 8. The continuous ring design is advantageous in that the user does not need to ensure that the cartridge magnet 24 is positioned adjacent the cradle magnet 22. However, as can be appreciated by a person skilled in the art, a magnet one a generally point location on the cartridge that generally aligns with the cradle magnet when the cartridge is in the inserted position would also be functional. Although the preferred embodiment shown in the figures includes only one magnet pair per cartridge/cradle combination, it can be appreciated by a person skilled in the art that multiple magnet pairs could be used. Alternatively, the magnets could be omitted.

Control Mechanisms

FIG. 8 shown the base 12 of the vape pen 2 with the cover 14 removed. Within a rear portion of the body 4 of the vape pen 2 opposite the mouthpiece 6, the control mechanisms 10 are housed. The control mechanisms 10 could be in the form of buttons, touch sensors or any other control mechanism known to a person skilled in the art. As shown in FIG. 1, the control mechanisms 10 are configured to be activated from the exterior of the vape pen 2. Although one control mechanism could be used to control multiple cartridges, in a preferred embodiment, each cartridge is controlled by its own control mechanism.

In a preferred embodiment, each cartridge could have a specific resistance value (i.e. by using different resistance heating elements) to automatically adjust for different heating characteristics specific to the particular consumable contained within the cartridge. In another embodiment, the cartridges can be identified in such a way that the preferred settings for that particular consumable would be automatically set. For example, the cartridges could be passively identified by a serialized identifier, chip or label on the cartridge which cooperates with an input apparatus, such as a sensor or electrical connection, to establish the identity of the cartridge inserted and adjust the operating parameters (for example, heating temperature or duration parameters) automatically for identified cartridge. While the above are examples of possible control mechanisms for a preferred embodiment, other similar control logic would be known to a person skilled in the art.

In an alternative embodiment, the vape pen 2 can be configured to be used in combination with a mobile app which allows the vape pen 2 to communicate with a user's mobile device through a dedicated software application. In the embodiment, the application would allow the user to control the operating parameters of the vape pen 2 (such as heating temperature or duration). In a preferred embodiment, the application would allow for finer adjustment than the control mechanisms 10. Additionally, the application could store predetermined temperature duration profiles which could be selected and uploaded into the vape pen 2. Furthermore, the application could allow for storage of commonly used or preferred temperature/duration profiles specific to the user.

The plurality of control mechanisms 10 are coupled to a single logic device 28, for example, a circuit board. The logic device 28 controls the adjustment parameter for each cartridge. Having a unitary logic device 28 reduces the cost and increases the ease of manufacture of the vape pen when compared with designs that employ separate logic devices for each cartridge.

Adjustment parameters can vary depending on the embodiment of the vape pen, however, examples of adjustment parameters are voltage to the heating element, power to the heating element or resistance. Each control mechanism adjusts a time average power output. Pulse width modulation can be used to control the output of vapor. Pulse width modulation is a method of reducing the average power delivered by an electrical signal. The average value of voltage (and current) fed to the load is controlled by turning the switch between supply and load on and off at a fast rate. The longer the switch is on compared to the off periods, the higher the total power supplied to the load. In the preferred embodiment, the user presses the control mechanisms 10 to cycle through three power levels. These control mechanisms allow the user to control the output of the device. Turning the power up will increase the flavor, intensity, and vapor production. Alternatively, simply controlling the heating temperature can also be used to control the vapor output.

Although any number of settings is possible, in a preferred embodiment, each cartridge has 3 control settings so that the user can adapt the vaping experience to their own preferences. In a further preferred embodiment, LED lights 32 are included below the surface of the cover. The transparency of the cover and the intensity of the LED lights 32 are configured such that, when lit, the LED lights can be seen through the cover. Each LED corresponds to an increase or decrease in the adjustment parameter of the particular vape pen and allows the user to visually identify the setting for each cartridge. In an alternative embodiment the LEDs are not below the surface of the cover, but rather holes in the cover are provided such that the LEDs are directly visible.

In a preferred embodiment, the vape pen is programed to provide dose control or dose awareness by providing user feedback at predetermined intervals. For example, the vape pen could provide a slight vibration at the predetermined interval of time. In this particular example, the consumer would feel a small vibration after a set period of time (i.e. 1.5 seconds) as they pull on the device. A person skilled in the art would appreciate that other methods of feedback or multiple methods of feedback could be used, such as but not limited to, a light, or a sound. In one embodiment, multiple feedback signals are provided to inform the consumer of their level of consumption. In one embodiment, feedback settings are customizable, for example with an app or adjustable setting on the vape pen itself, to the user's preference. It can also be appreciated that the feedback may be based on one or more properties, for example but not limited to, temperature of heating, flow rate of vapor, or heating duration, or draw duration. Providing feedback to the consumer allows the consumer to self regulate how much is being consumed based on the number of feedback signals. In one embodiment, the vape pen has the option to disable or may not even have an automatic shut off. This provides the consumer with control of their experience. In other embodiments, a user can set when the vape will automatically shut off based on the number of feedback signals. an idea on how much is being consumed by the number of vibrations they feel. By not having a designated 'shut off'—the consumer has further control. The preferred design shown in the figures also uses a single battery to power a plurality of heating elements in a plurality of cartridges. This is a simplified design when compared with pens that include a battery for each cartridge. Using one battery having multiple sets of terminals to connect with multiple cartridges, results in a streamlined design that is simple to charge and has reduced manufacturing costs.

In many designs available on the market, the mouthpiece is coupled to the cartridge and is disposed of with the cartridge when the cartridge is empty. The preferred design shown in the figures has a number of advantages. The mouthpiece 6 is integrated into to the body 4 of the vape pen 2. Thus, the mouthpiece is a permanent part of the pen and is not disposed of with each cartridge. In an alternative embodiment, the cartridge tip is rounded so it may be used as a mouthpiece in an alternative vape pen design, for example, a single cartridge design.

In a preferred embodiment, the vape pen output is controlled using an application. The vape pen 2 is equipped with wired or wireless communication capabilities, such as, but not limited to wifi, Bluetooth, RFID or any other suitable communication method. In this embodiment, the application is installed on an electronic device, preferably but not limited to a tablet or mobile phone.

The application can control various aspects of the vape pen, such as, the settings associated with each cartridge, for example the temperature of heating, or pulse modulation or intensity of the cartridge output. The application can save settings and document preferred past consumption experiences and share consumption preferences with others for example but not limited to friends, medical experts or an online vaping community enabled by the application. In one embodiment, the application is able to connect to other wearable technologies (for example Oura Ring™, or Whoop Bracelet™ etc.). By connecting to other wearable technology, information can be collected on the consumption of a user and used to learn what it best for the user given a desired or predetermined effect or outcome. This learning utilized information from the individual user and/or from a network of vape pen users on the application. The goal would be to use the vape pen application and technology to track, modulate and guide physical and mental wellbeing.

In one embodiment, the application can be used to control the dose of the consumable formulas and active ingredients (for example, but not limited to cannabinoids, terpenes, nicotine, and other ingredients). It could provide reminders to the user to use the pen. This is particularly advantageous for users that require a vape pen for medical treatments. Set programs designed by the company, or by other industry experts are integrated into the application and can be chosen by users or medical professionals as needed.

Although the above description includes reference to certain specific embodiments, various modifications thereof will be apparent to those skilled in the art. Any examples provided herein are included solely for the purpose of illustration and are not intended to be limiting in any way. Any drawings provided herein are solely for the purpose of illustrating various aspects of the description and are not intended to be drawn to scale or to be limiting in any way. The scope of the claims appended hereto should not be limited by the preferred embodiments set forth in the above description but should be given the broadest interpretation consistent with the present specification as a whole. The disclosures of all prior art recited herein are incorporated herein by reference in their entirety.

We claim:

1. A portable vaporizer comprising:

a body having a base portion in slidable engagement with a cover portion;

said body having a plurality of cradles included therein configured for receiving a cartridge for containing at least one consumable;

said cover being movable between an open position wherein the plurality of cradles are accessible, and a closed position wherein the plurality of cradles are contained between the base and the cover;

said body further comprising a mouthpiece defining an opening which is in communication with said plurality of cradles;

said portable vaporizer further comprising a battery that, when in use, cooperates with a heating element to vaporize said at least one consumable, wherein said body comprises at least a first compartment and a second compartment and a division therebetween, said division comprising at least one choke hole sized to restrict airflow between said first compartment and said second compartment, and wherein said first compartment houses the battery, and wherein the second compartment houses the plurality of cradles.

2. The portable vaporizer of claim 1 wherein said plurality of cradles includes two cradles.

3. The portable vaporizer of claim 1 further comprising at least one logic device for controlling adjustment parameters for each cartridge.

4. The portable vaporizer of claim 3 wherein said adjustment parameters is at least one of heating temperature, duration of heating, voltage provided to the cartridge, and duration of draw.

5. The portable vaporizer of claim 4 wherein three different level settings are provided for controlling each cartridge cradle.

6. The portable vaporizer of claim 5 further comprising a connectivity component for facilitating connection to a mobile device; and said mobile device is used to choose the settings for each cartridge cradle.

7. A portable vaporizer system comprising:

a vaporizer device and at least one cartridge containing at least one consumable;

said vaporizer device comprising a body having a base portion in slidable engagement with a cover portion;

said body having a plurality of cradles included therein configured for receiving said at least one cartridge;

said cover being movable between an open position wherein the plurality of cradles are accessible, and a closed position wherein the plurality of cradles are contained between the base and the cover;

said body configured to house a battery to power a heating coil configured to heat and vaporize the at least one consumable and having a mouthpiece defining an opening which is in communication with the cartridge to facilitate the inhalation of a vaporized at least one consumable therethrough, wherein said body comprises at least a first compartment and a second compartment and a division therebetween, said division comprising at least one choke hole sized to restrict airflow between said first compartment and said second compartment, wherein said first compartment houses the battery, and wherein the second compartment houses the plurality of cradles.

8. The portable vaporizer of claim 7, wherein said plurality of cradles includes two cradles.

9. The portable vaporizer of claim 7 further comprising at least one logic device for controlling adjustment parameters for each cartridge.

10. The portable vaporizer of claim 9 wherein said adjustment parameters is at least one of heating temperature, duration of heating, and voltage provided to the cartridge.

11. The portable vaporizer of claim 10 wherein three different level setting are provided for controlling each cartridge cradle.

12. The portable vaporizer of claim 11 further comprising a connectivity component for facilitating connection to a mobile device; and said mobile device is used to choose the settings for each cartridge cradle.

* * * * *